US005784530A

United States Patent [19]

Bridges

[11] Patent Number: 5,784,530

[45] Date of Patent: Jul. 21, 1998

[54] ITERATED ELECTRODES FOR OIL WELLS

[75] Inventor: Jack E. Bridges, Park Ridge, Ill.

[73] Assignee: EOR International, Inc., Canada

[21] Appl. No.: 600,671

[22] Filed: Feb. 13, 1996

[51] Int. Cl.[6] ..... E21B 7/15; E21B 36/00

[52] U.S. Cl. ..... 392/306; 166/60

[58] Field of Search ..... 392/301, 304, 392/305, 306; 166/59, 60, 61

[56] References Cited

U.S. PATENT DOCUMENTS

| | | | |
|---|---|---|---|
| 4,524,827 | 6/1985 | Bridges et al. | 166/248 |
| 4,783,585 | 11/1988 | Meshekow | 219/278 |
| 4,821,798 | 4/1989 | Bridges et al. | 166/60 |
| 5,070,533 | 12/1991 | Bridges et al. | 392/301 |
| 5,621,844 | 4/1997 | Bridges | 392/201 |
| 5,623,576 | 4/1997 | Deans | 392/306 |

OTHER PUBLICATIONS

Fields and Waves in Communications and Electronics, pp. 44–47, Ramo et al, 1965, J. Wiley and Sons, New York (p. 18).

Reference Data for Radio Engineers, pp. 22–23, H. Sames, ITT, 1968, New York (pp. 18, 19).

*Primary Examiner*—Matthew V. Nguyen

*Attorney, Agent, or Firm*—Dorn, McEachran, Jambor & Keating

[57] ABSTRACT

An electrical heating system for enhancing production from an oil well, particularly an oil well of the kind commonly known as a horizontal well, the well including an initial well bore extending downwardly from the surface of the earth through one or more overburden formations and communicating with a producing well bore extending from the initial well bore into at least one oil producing formation. The producing well bore may or may not be truly horizontal The heating system includes an electrode array comprising a plurality of at least three tubular, electrically conductive heating electrodes extending through the producing well bore. Each electrode has a given length, usually two to three meters, and a smaller diameter D. The sum of the electrode lengths is substantially less than the length of the producing well bore. The electrodes are spaced from each other by isolation sections; the length of an isolation section is much greater than the electrode diameter D. The heating system further includes an electrical power delivery apparatus for energizing the electrodes with A.C. power, but with a phase displacement of at least 90°.

13 Claims, 4 Drawing Sheets

ITERATED ELECTRODES FOR OIL WELLS

BACKGROUND OF THE INVENTION

Major problems exist in producing oil from heavy oil reservoirs due to the high viscosity of the oil. Because of this high viscosity, a high pressure gradient builds up around the well bore, often utilizing almost two-thirds of the reservoir pressure in the immediate vicinity of the well bore. Furthermore, as the heavy oils progress inwardly to the well bore, gas in solution evolves more rapidly into the well bore. Since gas dissolved in oil reduces its viscosity, this further increases the viscosity of the oil in the immediate vicinity of the well bore. Such viscosity effects, especially near the well bore, impede production; the resulting waste of reservoir pressure can reduce the overall primary recovery from such reservoirs.

Similarly, in light oil deposits, dissolved paraffin in the oil tends to accumulate around the well bore, particularly in screens and perforations to admit oil into the well and in the oil deposit within a few feet of the well bore. This precipitation effect is also caused by the evolution of gases and volatiles as the oil moves through the oil deposit into the vicinity of the well bore, thereby decreasing the solubility of paraffins and causing them to precipitate. Further, the evolution of gases causes an auto-refrigeration effect which reduces the temperature, thereby decreasing solubility of the paraffins. Similar to paraffin, other condensable constituents may also plug up, coagulate or precipitate near the well bore. These constituents may include gas hydrates, asphaltenes and sulfur. In certain gas wells, liquid distillates can accumulate in the immediate vicinity of the well bore, which also reduces the relative permeability and causes a similar impediment to flow. In such cases, accumulations near the well bore reduce the production rate and reduce the ultimate primary recovery.

Electrical resistance heating has been employed to heat the reservoir in the immediate vicinity of the well bore. Basic systems are described in Bridges U.S. Pat. No. 4,524,827 and in Bridges et al. U.S. Pat. No. 4,821,798. Tests employing systems similar to those described in these prior patents have demonstrated flow increases in the range of 200% to 400%.

Various proposals have been made over the years to use electrical energy for oil well heating, in a power frequency band (e.g. DC or 60 Hz AC), in the short wave band (100 kHz to 100 MHz), or in the microwave band (900 MHz to 10 GHz). Various down-hole electrical heat applicators have been suggested; these may be classified as monopoles, dipoles, or arrays of antennas. A monopole is defined as a vertical electrode whose length is somewhat smaller than the depth of the deposit; the return electrode, usually of large diameter, is often located at a distance remote from the deposit. For a dipole, two vertical, closely spaced electrodes are used and the combined extent is smaller than the depth of the deposit. These dipole electrodes are excited with a voltage applied to one relative to the other.

In the past, radio-frequency (RF) dipoles have been used to heat earth formations. These RF dipoles were based on designs used for the radiation or reception of electromagnetic energy in the radio frequency or microwave spectrum. In an oil well an RF dipole is usually in the form of a pair of long, axially oriented, cylindrical conductors. The spacing between these elongated conductors is generally quite close at the point where the voltage is applied to excite such antennas. The use of such dipoles emplaced vertically have been described, as in Bridges et al. U.S. Pat. No. 4,524,827, to heat portions of the earth formations above the vaporization point of water by dielectric absorption of short-wave band energy. However, such arrangements have been found to be costly and inefficient in heating moist earth formations, such as heavy oil deposits, because of the cost and inefficiency of the associated short-wavelength generators and because short wavelengths do not penetrate moist deposits as well as the long wavelengths associated with power-frequency resistive heating systems. Further, if an RF dipole is used to heat moist deposits by resistance heating the heating pattern is inefficient because the close spacing of the cylindrical conductors at the feed point creates intense electric fields. Such high field intensities create hot-spots that waste energy and that cause electrical breakdown of the electrical insulation.

Where heating above the vaporization point of water is not needed, use of frequencies significantly above the power frequency band is not advisable. Most typical deposits are moist and rather highly conductive; high conductivity increases losses in the deposits and restricts the depth of penetration for frequencies significantly above the power frequency band. Furthermore, use of frequencies above the power frequency band may require expensive radio frequency power sources and coaxial cable or waveguide power delivery systems.

Bridges et al. U.S. Pat. No. 5,070,533 describes a power delivery system which utilizes an armored cable to deliver AC power (2–60 Hz) from the surface to an exposed vertical monopole electrode. In this case, an armored cable for the kind commonly used to supply three-phase power to down-hole pump motors is employed. However, the three phase conductors are conductively tied together and thereby form, in effect, a single conductor. From an above-ground source, the power passes through the wellhead and down the cable to energize an electrode embedded in the pay zone of the deposit. The current then returns to the well casing and flows on the inside surface of the casing back to the generator.

A monopole design, such as disclosed in U.S. Pat. No. 5,070,533, represents the state of the art to install electrical resistance heating in vertical wells. However, the use of electrical heating arrangements like those employed for vertical wells introduces major difficulties in horizontal well completions. These difficulties must be addressed to make electrically heated horizontal wells practical and economical.

Drilling technology has advanced to a point where horizontal well completions are commonplace. In many cases, the length of a horizontal producing zone can be over several hundred meters. Horizontal completions often result in highly economic oil wells. In some oil fields, however, the results from horizontal completions have sometimes been disappointing. This may occur for some deposits, such as certain heavy oil reservoirs where a near-wellbore, thermally-responsive, flow impediment or skin-effect forms. In such cases, the use of electrical, near-wellbore heating offers the opportunity to suppress skin effects. This can make otherwise marginal heavy-oil or paraffin-prone oil fields highly profitable. To use electrical heating methods, existing vertical well electrical heating technology must be redesigned and tailored for horizontal completions.

Long horizontal well completions, or even long vertical well installations, that employ near well-bore electrical heating introduce several important problems not adequately resolved by application of the aforementioned vertical well electrical heating technology. The spreading resistance of the electrode (the resistance of the formation in contact with the electrode) is approximately inversely proportional to the length of the heating electrode. Typically, the spreading resistance of an electrode a few meters long in a vertical well is in the order of a few ohms. This electrode is supplied with power via a cable or conductor that usually has a resistance of a few tenths of an ohm. In the case of a vertical well, the resistance of the cable, the spreading resistance of the small electrode in the pay zone and the spreading resistance of the casing used as the return electrode are all in series. In this case the power dissipated in each resistance is proportional to the value of the resistance. (For a vertical well, the spreading resistance of the casing can be neglected.) For this example, only about ten percent of the power applied at the wellhead is dissipated in the power delivery cable.

In the case of a long horizontal electrode, however, the spreading resistance may be only a few tenths of an ohm because of the long length of the horizontal electrode. This value can be very small compared to the series resistance of the power delivery conductor. The spreading resistance of the horizontal electrode can be comparable to the spreading resistance of the casing, if the casing functions as the return electrode. Because the spreading resistance of the electrode is comparable to the series resistance of the return electrode and also to the resistance of the cable, only a small fraction of the power delivered to the wellhead will be dissipated in the deposit.

Another problem with applying vertical well electrical heating technology horizontally is the large power requirement implied by the long lengths of possible horizontal wells. For example, a producing zone of six meters depth with a five meter vertical electrode may exhibit an unstimulated flow rate of 100 barrels per day. Typically, the vertical well could be electrically stimulated with about 100 kilowatts (kW) to produce up to about 300 barrels of low-water content oil per day. For this example, the energy requirement at the wellhead would be about eight kilowatt hours (kWh) per barrel of oil collected. Assuming a power delivery efficiency of 85%, and a thermal diffusion loss of 20% from the heated zone to adjacent cooler formations, the power delivered to the deposit to increase the temperature of the nearby formation and ingressing oil to a temperature of 55° C. would be in the order of five kilowatt hours (kWh) per barrel. The power dissipation along the vertical electrode would be about 20 to 25 kilowatts (kW) per meter. This rather high power intensity, 20 kW per meter along the electrode, assures that the formation at least several meters away from the well bore will be heated to a temperature where the viscosity is reduced by at least an order of magnitude, thereby enhancing the production rate. The thermal diffusion of energy to adjacent non-deposit formations is suppressed by the compact shape of the heated zone, which has a low surface area to volume ratio and which experiences a high heating rate.

On the other hand, a single screen/electrode combination in a horizontal completion well may be as long as 300 meters. Based on vertical well experience, the unstimulated flow rate could be about 300 barrels per day with the expectation that the electrically stimulated rate would be increased to about 900 barrels per day. About 300 kW at the wellhead would be needed to sustain this stimulated flow, assuming conditions similar to the vertical well example discussed above. Further, assuming that the vertical well technology is applied to a horizontal well completion, the power dissipation along the horizontal electrode would be about one kW per meter as opposed to 20 kW per meter in the deposit for the vertical electrode.

In the above example there is a one kW dissipation per meter in the deposit along the horizontal screen/electrode, as opposed to the 20 kW dissipation per meter for the vertical screen/electrode. This low power intensity along the electrode/screen suggests that the temperature rise in the deposit along the horizontal screen may be much lower than that along the screen of a vertical well. The principal reasons are that the surface area to volume of the heated zone is much larger than for the vertical well, and the heating rate is too slow, enhancing the heat loss by thermal diffusion to the cooler nearby formations. The heat from this one kW per meter dissipation may be insufficient to raise the temperature of the heated zone to where the viscosity of the oil is reduced enough to afford worthwhile flow increase. This suggests that the well head power requirement per barrel of oil of eight kWh that was based on experience with vertical wells may be too low for a horizontal well with a long uninterrupted electrode.

An additional problem is that the electrical current distribution injected into the deposit from a long horizontal electrode may also be highly non-uniform. Similar non-uniform distributions have resulted in hot spots near the tips of vertical electrodes and has necessitated the use of expensive, high performance electrical insulation materials near the electrode tips of vertical wells. Similar hot spots can be expected to occur for horizontal completions, especially if the delivered power is in the order of several hundred kilowatts. Aside from the hot spots, such non-uniform heating along the electrode can result in inefficient use of electrical energy.

Another problem is that of heterogeneity of the horizontal formation through which the horizontal well is completed. If the resistivity of the formation varies along the length of the completion, greater heating rates may occur in regions where the resistivity is low. This could be a serious problem, since the location of the producing zone may not be accurately characterized. For example, if a horizontal well unknowingly is directed into a barren formation that has a low resistivity, most of the electrical heating power may be dissipated in this low resistivity barren region, thereby creating a hot spot and lowering the overall efficiency.

STATEMENT OF THE INVENTION

The overall objective of this invention is to configure the geometry and to control the excitation of the electrodes, in horizontal wells, such that substantial benefits from the electrical heat stimulation of horizontal wells can be more fully realized.

Specifically, an array including a series of relatively short horizontal electrodes is deployed in the horizontal well completion; the excitation, spacing and lengths of these smaller electrodes are chosen such that substantial resistance is presented to the power delivery conductors.

Groups of short electrodes are deployed so that at least one of the electrodes in the group, at any given time, serves as the return current electrode for one or more of the other electrodes in the group. Further, the excitation, spacing and lengths of these electrodes are chosen such that preselected regions of enhanced power dissipation and temperature rise occur along the horizontal borehole.

The excitation and geometry of preselected electrodes are controlled such that the power delivery efficiency is enhanced, thermal diffusion losses to adjacent formations are reduced, and the applied power more effectively utilized to stimulate the production of oil and gas.

The excitation and spacing of the short, iterated electrodes can be used to control the current distribution along the electrodes so as to suppress hot spots.

The spacing between electrodes is chosen to be large compared to the diameter of the electrodes to suppress excess heating effects between adjacent excited electrodes.

The excitation, positioning and spacing of the short electrodes is chosen such that an electrically stimulated production zone associated with one region of enhanced dissipation and temperature rise does not substantially overlap an adjacent electrically stimulated production zone.

In line with the foregoing objectives, the following specific benefits for horizontal, electrically heated wells utilizing the present invention are noted:

The amount of power needed to realize a significant economic benefit from electrical heating near the production borehole in a horizontal well can be reduced to economically attractive values; specifically, the capital equipment costs of the above-ground electrical equipment can be economically attractive.

The resistance presented to the power delivery conductors by the electrode assembly can be made sufficiently high to realize an acceptable power delivery efficiency with conventional cable or conductor designs.

The energy lost to adjacent formations by thermal diffusion can be reduced, thereby permitting more effective and efficient use of the applied electrical power.

The temperature rise in the formations near the electrodes can be made great enough to make electrical stimulation heating effective near the well bore.

The power requirements can be reduced without significantly affecting the electrically enhanced production rates.

Hot spots caused by excessive power dissipation near one or more electrodes can be suppressed to realize increased reliability and efficiency.

DETAILED DESCRIPTION OF THE PREFERRED EMBODIMENTS

A key factor is that power consumption is approximately proportional to the length of a horizontal screen/electrode, whereas an increase in flow of oil is not proportional to the length of the screen/electrode.

There are several methods of completing horizontal wells. One method is by forming a vertical shaft in a heavy oil deposit. Then, horizontal well bores are drilled radially outwardly up to about thirty meters from the vertical shaft. Studies have been conducted on the benefits of extending the length of such radial boreholes as well as increasing the number of radial boreholes. More typically, a single horizontal well can be realized by slowly deviating the angle of the borehole from vertical to horizontal on a large radius and guiding the drill to pass horizontally through the main portion of the deposit. Such apparatus typically can exhibit horizontal penetration of the reservoir in a range of one hundred to five hundred meters.

Figure 1:
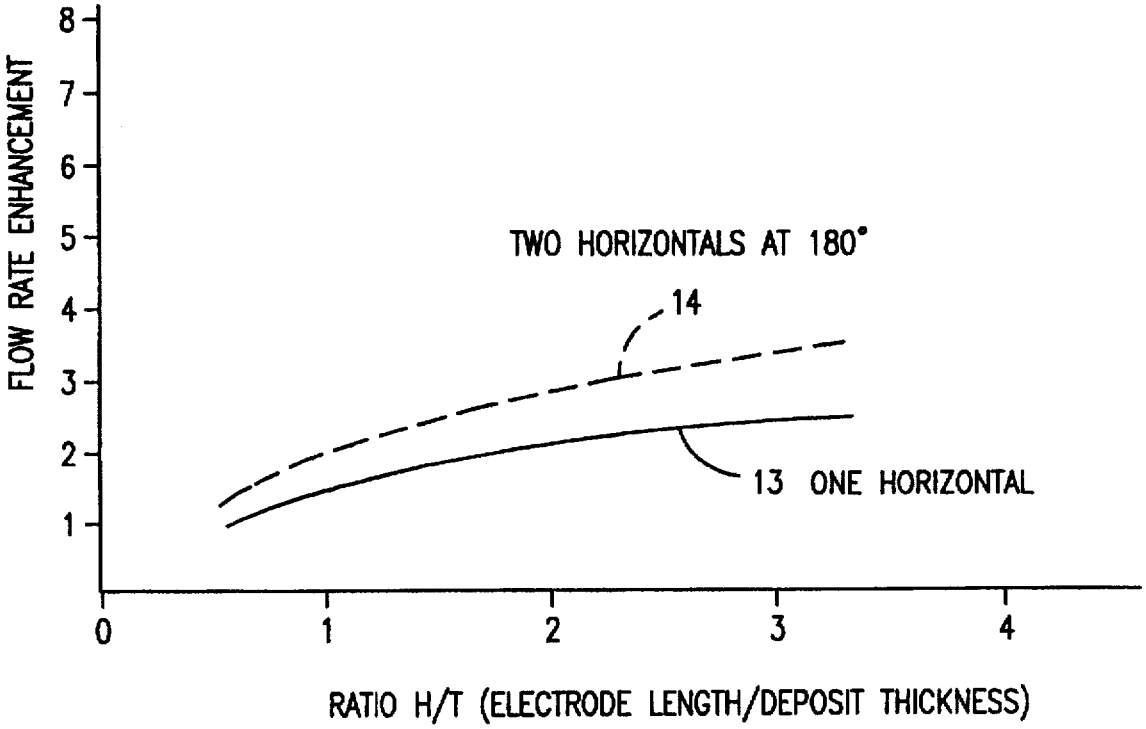
FIG. 1 is a graph that presents the approximate flow-rate enhancement for horizontal electrodes radiating from a vertical shaft or borehole and emplaced in a low API heavy oil deposit for one and two radials. The flow rate is normalized to that for a vertical well and the length of the horizontal borehole is normalized as a function of its length relative to the height of the producing formation.

In the case where radial well bores are formed from the shaft of a vertical well bore, the benefits are not proportional to the length of the radials drilled outwardly from the vertical well bore. FIG. 1 illustrates the flow rate enhancement as a function of either one horizontal (radial) bore, curve 13, or two radial bores that are 180 degrees opposed, curve 14; the horizontal length of each horizontal bore is normalized to the thickness of the deposit. Note that increasing the length of just one radial, curve 13, by a factor of four, only increases the production by a factor of about 2.5. Adding an additional radial in the opposite direction, curve 14, thus effectively increasing the length of the initial radial by a factor of two, further increases production by only approximately 32%. The reason is that zones of influence from adjacent horizontal bores (radials) overlap so that the production that would be realized from one radial completion is partially captured by the installation of an adjacent radial completion. Also, the ends of a horizontal completion tend to produce more oil than a similar section in the middle of the same horizontal completion. This occurs because the tips of the horizontal completion are exposed to a much larger section of the deposit and therefore have a much larger zone of influence than segments in the middle of the bore length.

Studies have demonstrated that the total production is not doubled if an additional well is installed too close to another well. The key to increasing production in a given reservoir by additional wells is to space them sufficiently such that zones of influence of adjacent wells do not overlap significantly.

The data shown in FIG. 1 are an important aspect of optimal design for electrically heated horizontal wells. The problem is that the design complexity and power required by an electrically heated well is nearly directly proportional to the length of a continuous horizontal heating electrode. On the other hand, the increase in flow rate is not proportional to the length of the electrode, but rather to some reduced fraction of that length. To offset this, groups of shorter electrodes, each of which creates a local region of enhanced dissipation and temperature rise, are deployed along the horizontal borehole, in accordance with the present invention. Each of these groups should be spaced such that the production zones of influence created in the high temperature regions do not overlap substantially. However, this spacing should still be close enough such that the reservoir pressure near the horizontal borehole at any position is maintained at some small incremental value above the pressure within the horizontal screen/electrode. This small incremental value should be a small fraction of the difference between the shut-in reservoir pressure and the pressure within the horizontal screen/electrode.

An examination of FIG. 1 shows that increasing the length of a horizontal screen electrode beyond about twice the thickness of the oil deposit does not produce a significant proportionate increase in oil production. Further examination of this data shows that the spacing between heated regions should be equal to or larger than 0.3 times the thickness of the deposit and preferably greater than one-third the thickness to prevent overlap in production zones of influence.

Figure 2:
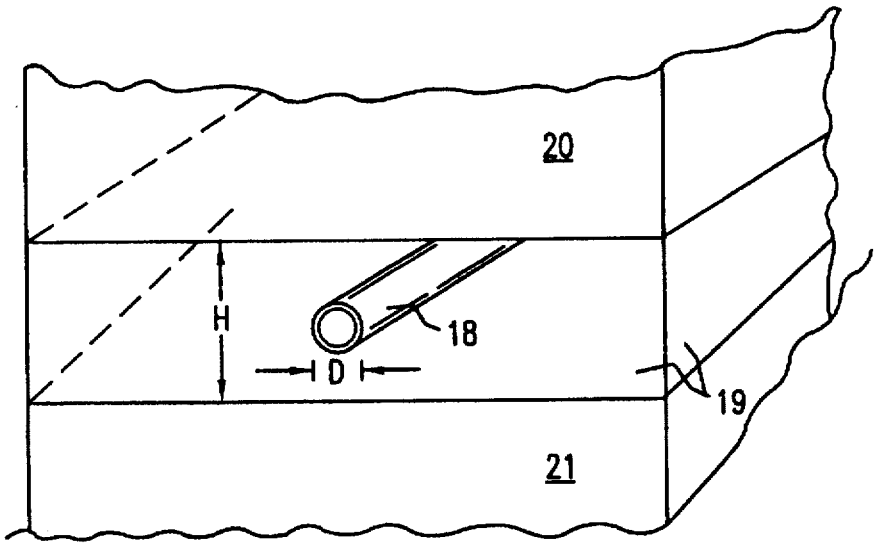
FIG. 2 is a simplified illustration of a "transmission line" characterization of a horizontal electrode emplaced in a heavy oil deposit between two highly conductive layers.

Additional problems arise in the case of a continuous horizontal electrode that is emplaced in a thin horizontal deposit. Such an arrangement can cause the resistance presented to the electrical power delivery system to be too low for efficient power delivery. In addition, as current flows along a screen/electrode some of the current leaks off into the over burden and the under burden. Such an arrangement is illustrated in FIG. 2. FIG. 2 shows an electrode 18 immersed in a moderately high resistivity oil reservoir 19 having a low height (depth) H. The reservoir 19 is located between two highly conductive formations, the overburden 20 and the under burden 21. Textbook relationships can be used to analyze the input impedance and the propagation losses along the horizontal electrode 18. General transmission line equations were used to compile Table 1 (see Table 1.23 and page 44–47 in "Fields and Waves in Communications and Electronics" by Ramo et al., 1965, J. Wiley and Sons, New York). Also, the characteristic wave impedance of a single cylindrical electrode between two conducting planes was used from "Reference Data for Radio Engineers", page 22–23, Howard Sams, ITT, New York, 1968. Calculations were made that used measured values of the series impedance of a steel tube and an aluminum tube. These results are illustrated in Table 1 for three cases where the resistivity of the reservoir is ten ohm-meters. The first case is for 60 Hz excitation using a casing diameter D of 4.5 inches (11.4 cm) for steel casing as the electrode and a spacing H of four meters between highly conducting barren layers 20 and 21 (see FIG. 2). In this example the series impedance of the casing was measured to be in the order of $10^{-3}$ ohms per meter. By reducing the operating frequency to six Hz, the skin effect of the high permeability of the steel was reduced, and this reduced the series impedance of the tubing to about $10^{-4}$ ohms per meter. For comparison, an aluminum tube was measured to have a series impedance of $10^{-5}$ ohms per meter. The calculations for Table 1 were based on a horizontal electrode equally spaced between two conducting layers in a ten ohms per meter deposit. The deposit is four meters thick (H, FIG. 2) and the conductor or electrode is equally spaced between the highly conducting layers 20 and 21 of over burden and under burden (FIG. 2).

TABLE 1

Horizontal Electrodes 18, Deposit Ten Ohm-meters, H Four Meters, Low Resistivity Burden Layers 20,21 (See FIG. 2)

| | 60 Hz Steel, D = 11.4 cm | 6 Hz Steel, D = 25 cm | 6 Hz Alum., D = 15 cm OD (12 cm ID) |
|---|---|---|---|
| Travel path along electrode for 50% of initial heating rate | 23 m | 60 m | 223 m |
| Input Impedance of electrodes for above 50% path | 0.2Ω | 0.083Ω | 0.02Ω |

It is seen from Table 1 that a current leaking or stripping effect occurs that limits the effective heating reach of a steel electrode to no more than sixty meters and of an aluminum electrode to no more than two hundred twenty three meters. The impedance presented to the power delivery system is quite low; it ranges between about 0.08 and 0.02 ohms for a six Hz excitation frequency for steel and aluminum respectively.

If the resistivity of the deposit is increased to twenty five ohm-meters, the heating reach at six Hz is increased to about 100 meters and 350 meters, respectively, for the steel and the aluminum conductors. Similarly, the input impedance is increased to 0.13 and 0.03 ohms, respectively, for the steel and aluminum conductors. Much of the input impedance for the steel electrode is caused by the higher series resistance of the steel electrode. As such, a substantial fraction of the power applied to the steel electrode will be dissipated in just heating the electrode rather than in heating the deposit.

One of the difficulties noted earlier, in extending vertical well completion methods to horizontal applications, is that in a vertical well the casing is usually used as the return electrode. In the case of a horizontal completion, the electrode length could be comparable to the length of the usual return electrode, the well casing. Thus, the spreading resistance of the barren formations near the casing would dissipate about as much power as the deposit formation near the horizontal electrode, thereby wasting power. One solution is for the return electrode(s) to become one of the electrode(s) in the horizontal borehole.

Figure 4:
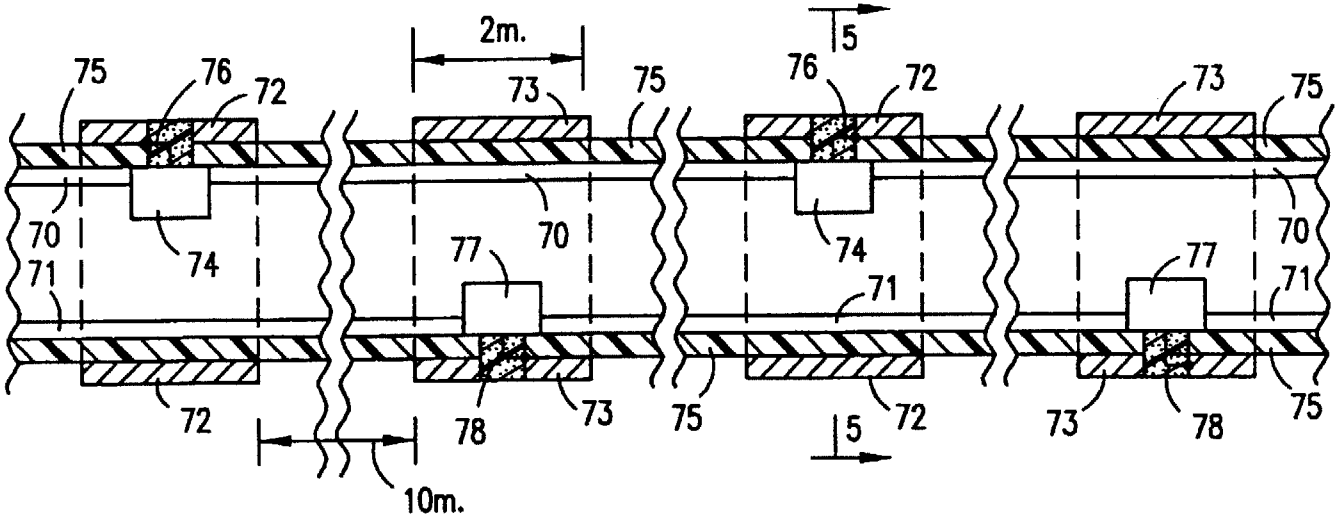
FIG. 4 is a longitudinal sectional view of a portion of a horizontal well completion employing a series of iterated electrodes.

Another advantage of using symmetrical excitation, as described below for FIG. 4, is that, for a fixed-length heating zone, each electrode exhibits about twice as much spreading resistance as for the monopole arrangement usually used in vertical wells, where the length of the electrode in the reservoir is much smaller than the return current electrode, ordinarily the production casing. To realize this advantage in a horizontal bore, the geometry of the electrodes may be about the same and the voltage applied to one electrode should be of opposite polarity to that applied to the nearby electrodes. This can be simply done by not grounding the output terminals of the power source or of the transformer that supplies power to the wellhead. Thus, by using a symmetrical excitation arrangement the power is more effectively applied to the deposit, minimizing power losses which would otherwise be wasted in a barren formation. The power delivery efficiency is improved by increasing the spreading resistance presented to the power delivery system.

Figure 3:
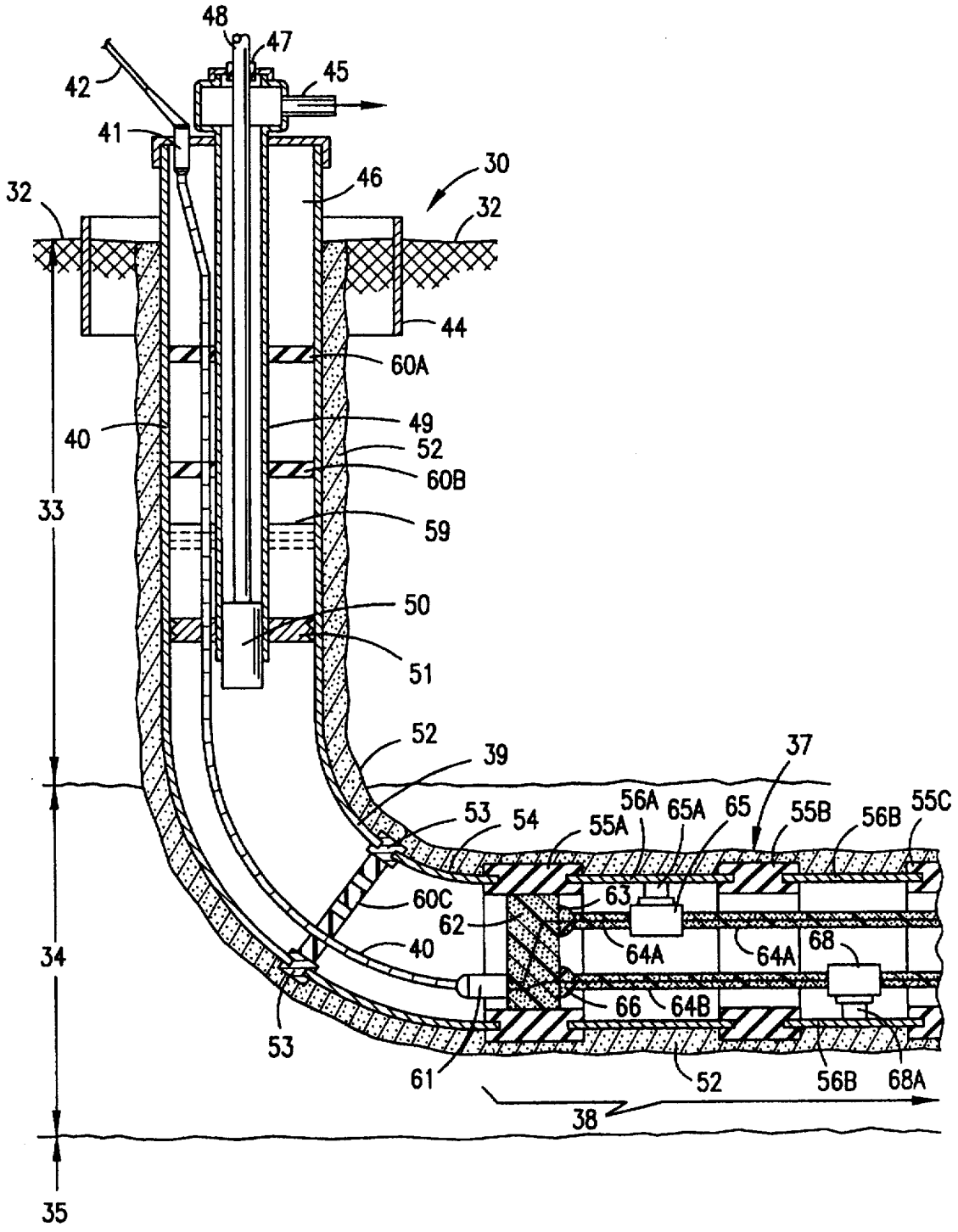
FIG. 3 is a simplified illustration of a series of iterated electrodes, showing just two electrodes, for a horizontal well completion.

The configuration shown in FIGS. 3 and 4 utilizes an iterated electrode array rather than a grouping of dipoles. The reasons are that the geometry and heating patterns of the commonly used RF dipole configuration are not appropriate to overcome the difficulties noted earlier. For example, the spacing between electrodes for an RF dipole configuration is small and may lead to inefficient use of electrical energy. On the other hand, the spacing between electrodes of the iterated array is much larger. Such spacing is determined by reservoir responses to electrical heating such that "zones of influence" from different electrodes only overlap partially, as determined from reservoir studies. This results in the total space occupied by all the electrodes in a horizontal borehole being typically less than fifty percent of the total length of that horizontal borehole. In addition, the heating patterns implied by the far-field radiation patterns of dipole arrays are only applicable if the media is dry. On the other hand, the media in a heavy oil deposit is usually moist and the heating pattern is controlled by the near fields rather than by the far or radiated fields.

FIG. 3 illustrates a well 30 that has been deviated to form a horizontal borehole. For illustrative purposes, longitudinal dimensions have been greatly foreshortened. In addition, the diameters of the casing and screen as illustrated may be different, depending on the depth of the well and the method of installing the screen/electrode assembly. Also, the lengths of the electrodes and FRP screen isolation sections are chosen for easy illustration; they may be significantly different for an actual installation.

The well 30, FIG. 3, is installed by first drilling a vertical borehole from the earth surface 32 through at least some of the overburden 33. The boring is deviated, in a deeper portion of the well 30, to form the generally horizontal section 37 of the borehole.

The radius of the deviation section 39 from the vertical portion of well 30 to its "horizontal" borehole 37 may be in the order of forty meters or even more (e.g., one hundred meters). The horizontal borehole 37 lies in an oil reservoir 34, between the overburden 33 and the underburden 35. After the boring tool is removed, a screen/electrode assembly 38 attached to a casing string 39 is lowered through the vertical borehole to be inserted into the horizontal borehole 37.

The upper part of the well 30, in the overburden 33, may be identical to the upper portion of the vertical, monopole-type well in FIG. 1 of U.S. Pat. No. 5,070,533 except that the cable 40, the feed-through connector 41, and the cable 42 to the power supply (not shown) have two conductors. These conductors are insulated one from the other and are supplied with power from an ungrounded two terminal source (or from two terminals of a three terminal source) where one terminal is positive phased with respect to ground and the other terminal is negative phased. Cable 40 within the well 30 may also have a metallic armor. The upper parts of the well 30 include a surface casing 44, a flow line 45 connection to a product gathering system (not shown), a wellhead chamber 46, a pump rod lubricator or bushing 47, a pump rod 48, a production tubing 49, a pump 50, and a tubing anchor 51. The pump 50 may be located below the liquid level 59 at any depth.

The casing string in well 30 is grouted as at 52, down to and beyond the packer/hanger 53 that attaches the upper casing to the more horizontal portions of the casing, blank spacers 54, and a screen/electrode assembly 38. The outermost portions of the screen/electrode assembly 38 in the horizontal borehole 37 includes the blank steel spacer section 54, fiber reinforced plastic (FRP) or other electrical insulator pipe sections 55A, 55B and 55C, a positive electrode 56A and a negative electrode 56B. These electrodes are formed from sections of steel pipe. The polarity designates the positive or negative phased A.C. terminals or connections. Direct current is not used. Both the FRP pipe sections and the electrodes are usually perforated or slotted to admit oil into the interior of the well; the well grouting is ordinarily porous enough for this purpose.

In the vertical portion of well 30 the insulated cable 40 is guided through two or more centralizers 60A and 60B that are perforated (perforations not illustrated) to permit liquid flow, and eventually extends through another centralizer 60C. The cable 40 is terminated in a connector assembly 61 that is attached to a dual-wire-cable-to-single-wire-cable plastic distributor block 62, which is also perforated for oil flow. A connector 63 connects one cable conductor to the single conductor in an insulated cable 64A. The conductor in cable 64A is connected to a "T" connector 65 that provides a connection 65A to electrode 56A. The other conductor from assembly 61 is connected, by a connector 66, to the conductor in a cable 64B that is similar in construction to cable 64A. The "T" connector 65 may also house a simple switch that will disconnect electrode 56A from the conductor in cable 64A if the temperature of electrode 56A becomes too high. Components 66, 64B, 68 and 68A provide similar functions, with electrode 56B connected to the wire in cable 64B by a connection 68A from "T" connector 68. Connections 65A and 68A are insulated as shown for the "T" connectors 74 and 77 in FIG. 4.

The deposit around the screen/electrode assembly 38 of FIG. 3 is heated by applying A.C. voltage to the two conductors of cable 42 at the surface 32. This causes A.C. current to flow through the down-hole cable 40 and thence to the conductors 64A and 64B in the screen/electrode assembly 38 in horizontal borehole 37. This applies an A.C. voltage between electrodes 56A and 56B, thereby causing current to flow through the reservoir liquids that fill the void between the horizontal borehole and the screen/electrode assembly 38 and the portions of the reservoir 34 that are adjacent to the electrodes. One advantage of the arrangement shown in FIG. 3 is that the return current electrode(s) (e.g., 56A or 56B) are in the deposit and no power or heat is wasted in adjacent barren formations, as might be the case if vertical well technology were routinely applied in the horizontal well 30.

FIG. 4 illustrates in more detail the iterated electrode construction of the invention. In this example, cylindrical, perforated electrodes 72 and 73 of about two meters length are positioned at ten meter intervals along the horizontal bore. The perforations in electrodes 72 and 73, and in other components illustrated in FIG. 4, have not been shown; they allow oil to enter the well casing. The electrodes 72 and 73 are spaced from each other by means of a perforated or slotted fiber-reinforced plastic pipe (casing) 75. By applying oppositely polarized potentials between adjacent electrodes, currents are injected into the reservoir that will heat the formations near the electrodes. The positively phased electrodes 72 are each connected to the positively phased conductor in the insulated cable 70 via the conductors 76 in a series of insulated "T" connectors 74. The negatively phased electrodes 73 are each connected to the negatively phased conductor in an insulated cable 71 via the conductors 78 in a series of insulated "T" connectors 77. Each electrode 72, 73 has an axial length of two meters; the inter-electrode spacing is ten meters.

Figure 5:
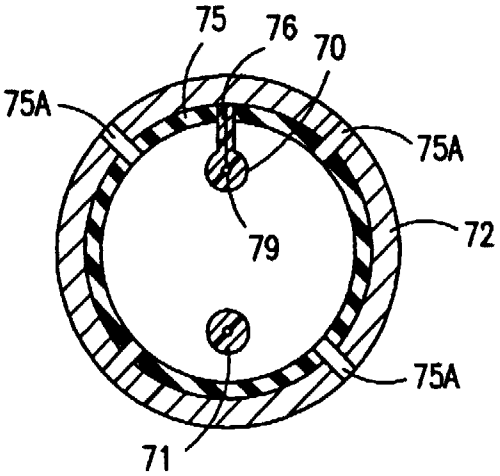
FIG. 5 is a cross section taken approximately along line 5—5 in FIG. 4.

FIG. 5 shows a cross section of the screen/electrode assembly taken approximately along line 5—5 in FIG. 4. FIG. 5 includes some of the perforations or slots 75A that are needed to permit fluids to enter the electrodes and their support, the FRP casing or pipe 75; perforations 75A are small enough to prevent sand particles from entering with the oil. The conductor 79 in cable 70 is covered with insulating material and provides a conductive connection between the insulated cable 70 and the electrode 72.

As discussed above and illustrated in FIG. 1, doubling the length of a horizontally completed well in a homogeneous reservoir does not double the production rate. On the other hand, doubling the length of the electrode in a horizontal electrically heated well doubles the power requirements, but also may not provide an increase in the oil flow rate proportionate to the increase in power.

The much increased surface-to-volume ratio of the heated formations near a long uninterrupted horizontal electrode is another cause for inefficiency. Such an increase will greatly augment the thermal diffusion losses to adjacent formations in comparison with those experienced in vertical wells. The low power injected per meter along an uninterrupted horizontal electrode also makes it difficult to increase the temperature of the formations adjacent a long horizontal electrode to a temperature high enough to significantly reduce the viscosity.

To address these difficulties, it is more effective to use a series of small (short) electrodes that are widely spaced along the horizontal screen, as illustrated in FIG. 4. Each of the heated volumes near each electrode then has a surface-to-volume ratio and heating rates similar to those experienced for vertical well heating electrodes, thereby suppressing excessive heat losses due to thermal diffusion. If properly done, such would reduce the power requirements as well as increase the input resistance and reduce the thermal diffusion losses.

Figure 6:
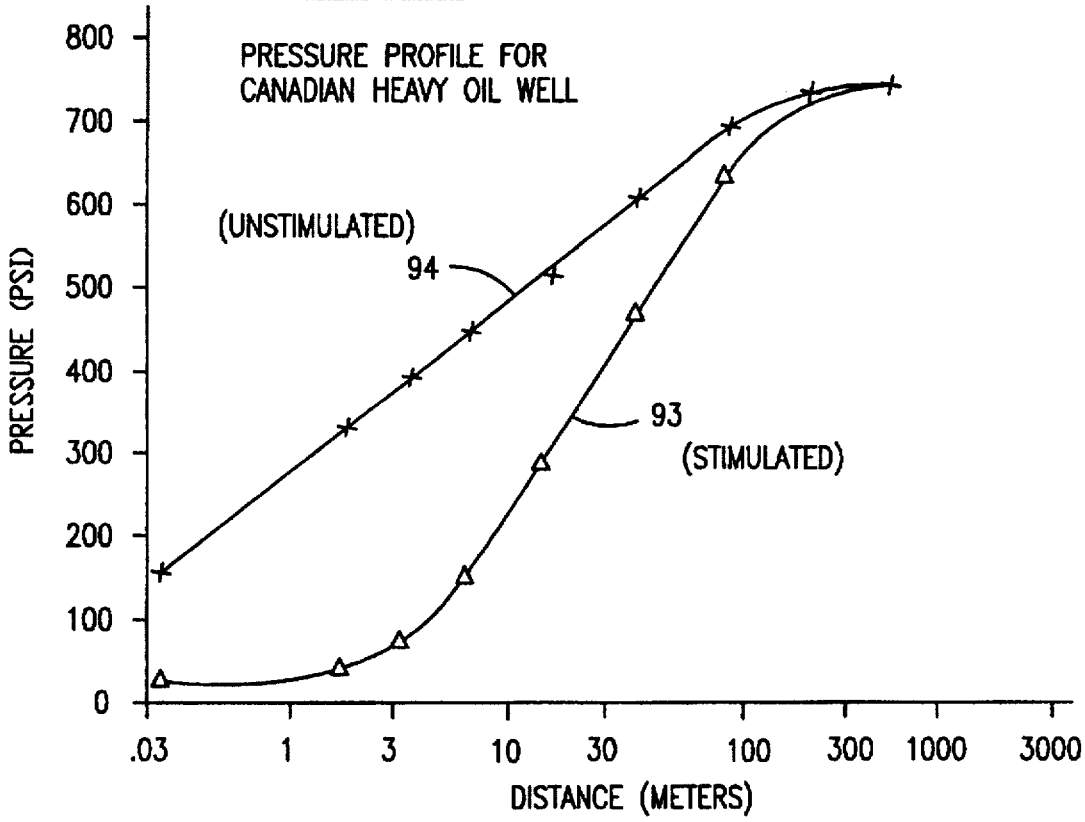
FIG. 6 is a graph that presents the pressure profile as a function of the radial distance from the well for a heavy oil well in Canada. Two profiles are presented: one for unstimulated production and the other for electrically stimulated near-well bore heating.

FIG. 6 provides some insight as to the size and spacing of the iterated electrodes of this invention. In FIG. 6 the pressure difference between the shut-in reservoir pressure and the pressure in the well near the perforations is shown as a function of the radial distance from the well. Curve 93 is with and curve 94 is without electrical stimulation. The reservoir parameters used are representative of those found for a vertical electrically heated well in a heavy oil reservoir in Canada. Note that the electrical heating from this one well significantly reduces the flowing reservoir pressure out to a distance of about 4.5 to 6 meters (15 to 20 feet).

Figure 7:
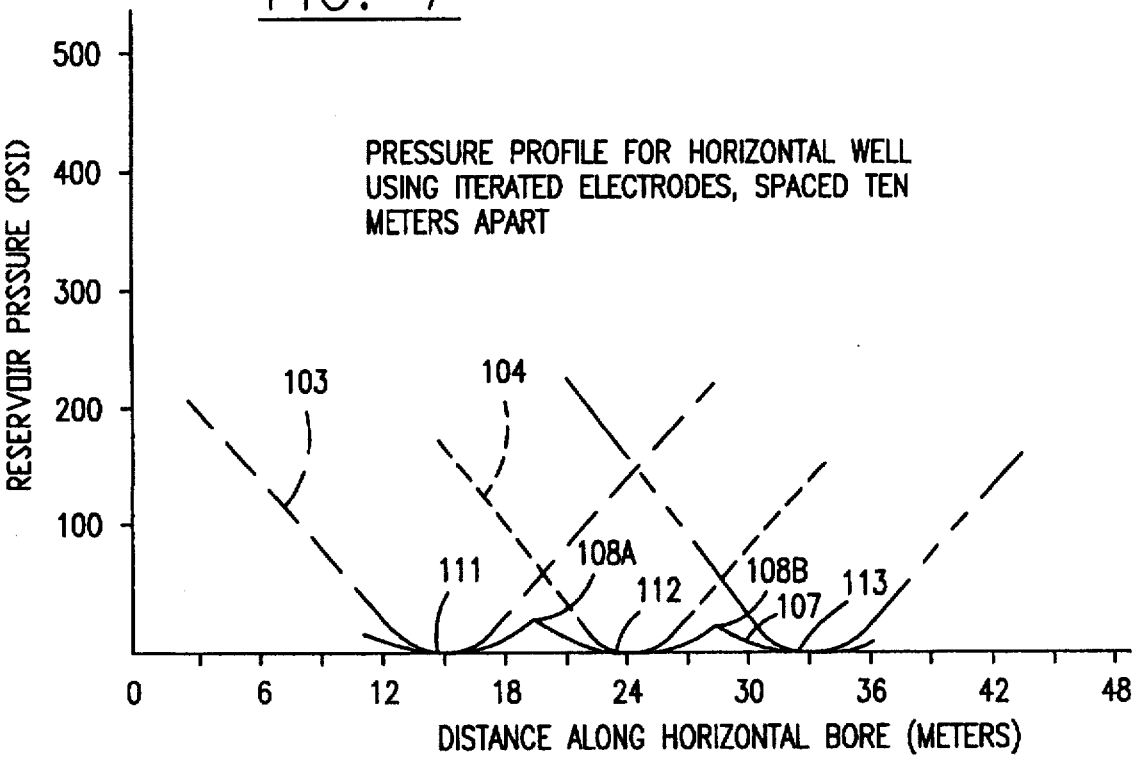
FIG. 7 is a graph that presents an estimated pressure profile for an iterated electrode horizontal well configuration as a function of distance along the horizontal borehole.

This suggests that short horizontal electrodes (three meters length) need not be spaced closer than ten meters (30 feet) apart. Using the data from FIG. 6, FIG. 7 was developed. FIG. 7 plots the pressure drop (as previously defined for FIG. 6) against the distance along an iterated horizontal bore completion. This drop was estimated using a ten meter spacing between three meter electrodes at spacings 111, 112 and 113. This was done by taking curve 92 of FIG. 6 and plotting it symmetrically with respect to each of the center points of the three electrodes. These plots are shown in curves 103, 104 and 105. The composite pressure drop is shown by curve 107; curve 107 is developed by combining the pressure drops from curves 103–105. Note that in the overlap regions between electrodes the pressure drop is reduced substantially, such that at points 108A and 108B the pressure drop found for just one of the two adjacent electrodes is reduced by a factor of about two. These effects almost simulate the pressure drop effect of a continuously slotted horizontal electrode, but the iterated arrangement does not have the disadvantages of a continuous electrode.

TABLE 2

Design Example, Horizontal Bore Iterated Electrodes, Connected in Pairs, All Pairs in Parallel

| | |
|---|---|
| Power Supply: | |
| Rating | 400 Kw |
| Load resistance (minimum) | 1.7 ohms |
| Maximum current | 480 amps |
| Operating frequency | 6 Hz (or higher) |
| Reservoir: | |
| Thickness (height) | 4 meters |
| Resistivity | 25 ohm-meters |
| Horizontal bore length | 300 meters |
| Unstimulated production rate | 300–500 bbl/day |
| Iterated Electrodes: | |
| Length | 2 meters |
| Diameter | 0.2 meters |
| Spacing between paired electrodes | 6 meters |
| Spacing between electrode pairs | 30 meters |
| Total number of electrode pairs | 10 |

TABLE 2-continued

Design Example, Horizontal Bore Iterated Electrodes, Connected in Pairs, All Pairs in Parallel

| | |
|---|---|
| Spreading resistance per electrode | 8.7 ohms |
| Spreading resistance, total | 1.7 ohms |
| Power dissipation/pair | 40 Kw |

Table 2 presents a "first-cut" design example for an iterated electrode in a horizontal well. The purpose is to demonstrate, using plausible values, that practical and economically attractive configurations of the iterated electrode line are possible. This assumes a configuration such as those illustrated in FIGS. 3 and 4. The other assumptions are noted in Table 2. The power delivery requirement of 400 Kw over a frequency range of three Hz to no more than 3000 Hz was considered to be practical. A maximum current in the range of 500 to 650 Amperes into a 1.7 ohm load resistance is within the state of the art for existing power conditioning units that have been successfully field tested. The required current carrying capacity of 480 amperes is within a factor of two or less of the published rating for the total current carrying capability of the larger diameter downhole pump motor cables. The reservoir parameters are plausible for a Canadian heavy oil deposit with a 300 meter horizontal completion.

The parameters chosen for the iterated electrode array were chosen for illustrative purposes. The spreading resistance of each electrode as an isolated element in a homogeneous medium was developed as follows: Spreading Resistance={(resistivity)/(2πL)}ln{2L/a−1}, where "L" is the length of the electrode and "a" is its radius. This value was calculated to be about 8.7 ohms; each of the pairs would exhibit twice that resistance, or 17.4 ohms. Ten pairs of these electrodes in parallel would have a resistance of about 1.7 ohms. Such a high load resistance permits high power delivery efficiencies both within the casing and within the horizontal screen.

The wellhead power per electrode pair is 40 Kw or about 30 Kw per electrode pair in the deposit assuming reasonable values for delivery efficiencies and thermal diffusion losses. Ideally, 40 Kw of electrical stimulation, at the wellhead, per pair of electrodes should stimulate production of low water content oil by about 100 to 150 bbl/day per pair. The overall production increase would be from 300 to 500 bbl/day to 1000 to 1500 bbl/day.

The average power dissipation per meter of electrode length is 10 kW per meter, referencing the wellhead input. This is sufficient to provide about 240 kWh per day per meter of electrode. At 8 kWh of power at the wellhead per barrel of oil produced, this results in a stimulated production of up to thirty barrels/day per meter of electrode length and up to 1200 bbl/day overall. The effectiveness of the electrical stimulation is progressively reduced as the heating rate per meter of electrode length is reduced. Very slow heating rates allow substantial thermal diffusion to occur, even if the heating zone is quite compact. This reduces the effectiveness of the electrical stimulation. The lower limit for the heating rate is controlled by the thermal diffusion properties of the formation, the oil-to-water ratio, and the amount of ingressing liquids per meter length. A lower limit of 1.5 kW per meter can be used as the lower bound for the average power dissipated per meter of electrode for high resistivity deposits and low production overall production rates. Higher power dissipation per meter of electrode length is preferred, in the order of 3 kw per meter and higher.

The lower limit on the value of resistance (impedance) presented to the power delivery system should be at least twice the value of the series resistance of the power delivery system that appears at the feed point to the interated array, such as at the connector 61 in FIG. 3. If the power is delivered via cable, the series impedance of conventional power cables that deliver power to downhole pumps would be no less than 0.3 ohms per 1000 meter length. They would require the resistance presented by the array to be at least 0.6 ohms to realize a 67% power delivery efficiency.

The lowest limit on the resistance presented to the power delivery system can be estimated based on the assumption that an idealized downhole transformer is used to terminate a conventional power delivery cable and that the series impedance of the power cable and transformer is negligible. In this case the lower limit on the load impedance will be determined by the current carrying capacity of the insulated conductors used within the screen to carry the current to the electrodes in the array. The largest size metallic conductor would not exceed one inch (2.54 cm) in diameter, excluding insulation. Assuming a power dissipation limit along the conductor of about 80 to 100 watts per meter length of a one inch diameter copper conductor, the maximum continuous load current would be about 1400 amperes. To deliver 400 kW at 1400 amperes requires a load resistance no smaller than 0.2 ohms.

While the foregoing techniques have been described in the context of a long horizontal completion, there are some vertical well installations that may require the use of an iterated electrode design. Such a well typically would exhibit high unstimulated flow rates and lengths in excess of ten meters. The spacing of the electrodes would also be governed according to the vertical resistivity profile wherein the electrodes would be placed in regions of high resistivity and fluid permeability. Regions of low resistivity would be avoided as well as regions of low oil saturation and/or fluid permeability.

In the case of horizontal wells, the assumption that the deposit is precisely horizontally layered may not apply. Therefore, the electrode emplacement considerations just noted for a vertical well would also apply for a quasi-horizontal well; in this specification and in the appended claims, the term "horizontal" should be recognized as including quasi-horizontal well completions.

I claim:

1. An iterated electrode heating system for a horizontal oil well comprising an initial well bore extending downwardly from the surface of the earth through one or more overburden formations, and a producing well bore, deviating appreciably from the initial well bore, communicating with and extending into at least one oil producing formation, the iterated electrode system being located in the producing well bore and comprising:

an iterated electrode array including a plurality of separated conductive tubular electrodes of given diameter that are electrically isolated from one another and that extend through an oil producing well bore zone;

each electrode in each array having a given length, the sum of the lengths of the electrodes being substantially less than the length of the oil producing well bore zone;

each electrode being spaced from adjacent electrodes in the array by a non-conducting isolation section, the length of the isolation section being substantially larger than the electrode diameter; and an electrical power delivery apparatus connected to the electrodes to energize the electrodes with A.C. power with a phase difference between electrodes of at least 90 degrees.

2. An iterated electrode system for heating an oil producing formation adjacent a producing oil well bore, according to claim 1, in which each electrode has a length of at least about 1.5 meters.

3. An iterated electrode system for heating an oil producing formation adjacent a producing oil well bore, according to claim 2, in which the power delivery apparatus includes two or more power conductors and in which the electrode lengths and the isolation section lengths are selected to present substantial resistance, about five ohms or more, to each power conductor.

4. An iterated electrode system for heating an oil producing formation adjacent a producing oil well bore, according to claim 3, in which each electrode creates a local region of enhanced temperature rise in the oil producing formation, and the local regions do not overlap substantially.

5. An iterated electrode system for heating an oil producing formation adjacent a producing oil well bore, according to claim 4, for use in an oil producing formation having a height H, in which the isolation section length is at least one-third of H.

6. An iterated electrode system for heating an oil producing formation adjacent a producing oil well bore, according to claim 1, in which the average power dissipation over the length of the electrode array is in excess of 1.5 kW per meter of electrode length.

7. An iterated electrode system for heating an oil producing formation adjacent a producing oil well bore, according to claim 3, in which the total impedance of the electrode array is at least about twice the series impedance of the power delivery apparatus.

8. An iterated electrode system for heating an oil producing formation adjacent a producing oil well bore, according to claim 7, in which the impedance to the power delivery apparatus is in excess of about 0.2 ohms.

9. An iterated electrode system for heating an oil producing formation adjacent a producing oil well bore, according to claim 1, in which the overall length of the electrode array exceeds fifty meters.

10. An iterated electrode system for heating an oil producing formation adjacent a producing oil well bore, according to claim 1, in which each electrode in the array serves as a return current electrode for at least one other electrode in the array.

11. An iterated electrode system for heating an oil producing formation adjacent a producing oil well bore, according to claim 1, in which the producing well bore is deviated radially outwardly from the initial well bore and the electrode array has a total length of at least about two hundred meters.

12. An iterated electrode system for heating an oil producing formation adjacent a producing oil well bore, according to claim 11, in which the oil well includes a plurality of producing well bores each deviated radially outwardly from the initial well bore, and in which each producing well bore has an iterated array of a plurality of electrically conductive tubular electrodes electrically isolated from each other.

13. An iterated electrode system for heating an oil producing formation adjacent a producing oil well bore, according to claim 1, in which each electrode length is in the range of about two to five meters, each isolation section length is at least five meters, and the overall length of the array is at least two hundred meters.

* * * * *